US005409760A

United States Patent [19]

Neitz et al.

[11] Patent Number: 5,409,760

[45] Date of Patent: Apr. 25, 1995

[54] CAMOUFLAGE MATERIALS FOR REDUCING VISUAL DETECTION BY DEER AND OTHER DICHROMATIC ANIMALS

[75] Inventors: Jay Neitz, New Berlin, Wis.; Don H. Anderson, Santa Barbara; Lincoln V. Johnson, Pasadena, both of Calif.; Gregory S. Hageman, Chesterfield, Mo.

[73] Assignee: Ocutech, Inc., Chesterfield, Mo.

[21] Appl. No.: 19,129

[22] Filed: Feb. 16, 1993

[51] Int. Cl.[6] ..... B32B 3/00

[52] U.S. Cl. ..... 428/195; 428/207; 428/212; 428/224; 428/245; 428/919; 8/478

[58] Field of Search ..... 428/195, 207, 224, 288, 428/919, 245, 212; 8/478

[56] References Cited

U.S. PATENT DOCUMENTS

| | | | |
|---|---|---|---|
| 4,656,065 | 4/1987 | Yacovella | 428/17 |
| 4,868,019 | 9/1989 | Knickerbocker | 428/17 |
| 5,043,202 | 8/1991 | Knickerbocker | 428/195 |

OTHER PUBLICATIONS

Murphy, Brian P. et al., Photopigments of white-tailed deer. Abstract. Presented Feb. 21-24, 1993 at Southeast Deer Study, 16th Annual Meeting, Jackson, Miss.

Gillins, P. "The Deer in the Brush 'Turned Out to be a Guy's Beard.'" *UPI Report* (Oct. 1, 1986).

Neitz, J., "Spectral sensitivity of cones in an ungulate." *Visual Neuroscience* 2: 97-100 (1989).

Neitz, J., "Color vision in the dog." *Visual Neuroscience* 3: 119-125 (1989).

Mandile, T., "Now They See You, Now They Don't." *Outdoor Life*, Jul. 1990, pp. 80-90.

von Besser, Kurt, "How Game Animals See." Published by ATSKO/SNO-SEAL, Inc., Orangeburg, S.C. (pp. 1-32, date of publication unknown).

Storey, J., *Manual of Dyes and Fabrics*, (1992), p. 86. (Publishers: Thames and Hudson).

Highland Brochure, "We're Committed to Your Success." 14 Pages. Published by Highland Industries, Inc., Greensboro, N.C. (date of publication unknown).

*Primary Examiner*—Patrick J. Ryan
*Assistant Examiner*—Marie R. Macholl
*Attorney, Agent, or Firm*—Joe Liebeschuetz; Karen B. Dow; William M. Smith

[57] ABSTRACT

Camouflage materials that are highly visible to humans but inconspicuous to dichromatic animals are provided. The camouflage materials emit, or simulate emission, of light at or about the neutral point of a dichromatic animal. One kind of camouflage material contains a coloring agent, which limits photopic light emissions from the material to occur at or about the neutral point. Another kind of camouflage material contains at least two coloring agents, which limit photopic light emissions to at least two bands of wavelengths. The respective proportions and spectral properties of these coloring agents are chosen so that the combination of photopic light emitted by camouflage materials incorporating them simulates the appearance of monochromatic light at or about the neutral point.

21 Claims, 2 Drawing Sheets

CAMOUFLAGE MATERIALS FOR REDUCING VISUAL DETECTION BY DEER AND OTHER DICHROMATIC ANIMALS

TECHNICAL FIELD OF THE INVENTION

This invention applies the technical field of comparative visual physiology in the design of camouflage materials that reduce visual detection by deer and other dichromatic animals.

BACKGROUND OF THE INVENTION

In humans, normal (trichromatic) color vision is conferred by the presence of three populations of cone photoreceptor cells in the retina of the eye. The retina also contains rod photoreceptor cells that detect the brightness (i.e., luminosity) of incident light. Rods function primarily at night and under low light (i.e., scotopic) conditions; whereas cones function at the higher intensities typically present during daylight hours (i.e., photopic conditions). It is the cones, rather than rods, that are responsible for generating our sense of color. The cone cells contain photosensitive pigments, and in different populations of cone cells, the pigments are maximally sensitive to different wavelengths of light. The three human types of cone cell have absorption maxima at approximately 420 nm, 530 nm and 560 nm, and are described as blue-absorbing, green-absorbing and red-absorbing respectively, corresponding to the color of light at the absorption maxima. Because of their different absorption spectra, the three classes of pigments absorb light of any given wavelength to different extents. The differential absorption of the three classes of cells is transmitted to the brain, and the information processed from this signal generates human perception of color. If all three photopigments are stimulated about equally, as by incidental light containing a mix of all visual wavelengths, no differential signal reaches the brain, and the light appears colorless. Colorless light is seen as white or a shade of gray, depending on its intensity and the background illumination.

The color vision conferred by the three human cone populations is dependent upon those portions of the electromagnetic spectra that reach the retina. Before reaching the retina, light must pass through the cornea, lens and vitreous humor. In humans, the yellowish coloration of the lens acts as a "cut-off" filter, effectively limiting the transmission of short wavelength blue and near ultraviolet light to the retina. Thus, humans have very low sensitivity to light of these wavelengths.

The color vision of many nonhuman vertebrates differs from that of humans in several respects. Most notably, many mammals, including deer, pigs, cows, other ungulates, rabbits, squirrels, dogs and cats have only two populations of cone photoreceptors compared with three in humans. Pigs, for example, have two photopigments with absorption maxima at about 440 nm and 560 nm (Neitz et al. (1989), Visual Neuroscience 2: 97–100). These species are said to possess dichromatic vision. Dichromatic vision results in a very limited color perception compared with trichromatic. Whereas trichromatic humans can perceive several hundred color gradations from different wavelengths in the visible spectrum, dichromatic animals can perceive only two distinct colors with gradations of colorlessness in between. Thus, at low wavelengths of incident light, a dichromat perceives a blue color. As the wavelength is raised, the intensity of blue color decreases. Eventually, the blue color completely disappears and the light appears entirely colorless. On further increasing the wavelength, an increasing intensity of yellow appear, until eventually the yellow light appears relatively pure (i.e., saturated). The wavelength at which light appears entirely colorless, untinted by either blue or yellow coloration, is that at which the two populations of cone cells are equally stimulated. This wavelength is known as the neutral point. The colorless light, at or around the neutral point, is perceived as white or a shade of gray, depending on its intensity and the background illumination.

A further notable difference in vision between many nonhuman vertebrates and humans, is that the former lack the human's yellow coloration of the lens of the eye. In nonhuman vertebrates lacking the yellow coloration, short wavelength blue and ultraviolet light that would be filtered out in humans, reaches the nonhuman's retina. Thus, some nonhuman vertebrates have much greater sensitivity that humans to short wavelength light.

Traditional camouflages for human observation of animals have not exploited the differences in color vision of humans and animals. A traditional camouflage might comprise a mixture of browns and greens to simulate the forest background against which a human observer would be perceived by an animal. Such a camouflage may indeed make a human inconspicuous to animals. The difficulty with this approach is that a person so camouflaged is equally inconspicuous to other humans. When other humans are engaged in hunting, this presents a dangerous situation for the camouflaged human being of being mistaken for a target animal. Indeed, several fatal and crippling accidents have been reported. See, e.g. Gillins, UPI Report (Oct. 1, 1986).

The high incidence of hunting accidents from use of traditional camouflages has led the legislatures of many states to require hunters to wear clothing comprising "Hunter's Orange" (otherwise known as "daylight fluorescent orange" fabric). This fabric must emit at least 85% of luminance in a narrow band of wavelengths ranging between 595–605 nm and in addition, have at least a 40% luminosity factor. This band of wavelengths is near the peak of human visual sensitivity at 555 nm (Wysecki and Stiles (1982)). Thus, use of Hunter's Orange results in a fabric that is highly visible to humans and helps to avoid accidents. However, as revealed by the present disclosure, Hunter's Orange contrasts strongly with a dichromatic animal's perception of a natural background. Thus, Hunter's Orange fabrics achieve safety at some cost to utility and are far from ideal for assembly of camouflage clothing.

A product termed U-V-Killer TM solution (Atsko/-Sno-Seal Inc., Orangeburg, S.C. 29115) has recently been reported for treating fabrics (blaze orange or otherwise) to reduce conspicuousness to animals. The problem sought to be addressed by treatment with the product is the reflection of ultraviolet irradiation caused by trace amounts of brighteners present in the fabric. Mandile, *Outdoor Life* (July, 1990) pp. 81–88. The traces of brighteners are absorbed by the fabric when it is washed in conventional detergent. U-V-Killer TM solution (Atsko/Sno-Seal Inc., Orangeburg, S.C. 29115) allegedly blocks the ultraviolet irradiation emitted by the brighteners. However, under daylight illumination the contribution of trace amounts of brighteners to total emissions is probably insignificant. Thus, treatment with U-V-Killer TM solution (Atsko/Sno-Seal Inc., Orangeburg, S.C. 29115), which does not change the residual spectrum of light emitted by conventional camouflage materials without brighteners, will not appreciably affect an animal's perception of these materials under daylight illumination.

Therefore, a need exists for a camouflage fabric that appears highly conspicuous to humans and yet blends into the background as perceived by dichromatic animals, particularly deer, under normal daylight illumination. The present invention exploits differences in color vision between trichromatic humans and deer to fulfill this and other needs.

SUMMARY OF THE INVENTION

The invention provides at least three different kinds of camouflage materials that are highly visible to humans but inconspicuous to dichromatic animals. In one embodiment, monochromatic neutral-point material is provided. This material comprises a coloring agent, which limits photopic light emissions from the material to occur predominantly within a band of wavelengths at or about the neutral point of a dichromatic animal.

In a second embodiment, multichromatic neutral-point material is provided. This material comprises first and second segments, which contain different coloring agents. The first segments contain a first coloring agent, which limits photopic light emissions from these segments to occur predominantly within a first band of wavelengths. The second segments contain a second coloring agent, which limits photopic light emissions from these segments to occur predominantly within a second band of wavelengths. The first and second segments are arranged so that a human observer cannot spatially resolve the different colored segments in a Two-Alternative Forced Choice Test. The combined photopic light emissions from the first and second segments induce equal or nearly equal quantal absorptions by first and second populations of color photoreceptors in a dichromatic animal.

In a third embodiment, a low-visibility red material is provided. This material comprises a coloring agent, which limits photopic light emissions from the material to occur predominantly within a band of wavelengths from about 640–700 nm.

Also provided is a coloring medium comprising a coloring agent, which limits the photopic light emissions from the coloring medium to be predominantly within a band of wavelengths at or about the neutral point of a dichromatic animal.

Also provided is a coloring medium comprising first and second coloring agents. The first and second coloring agents limit photopic light emissions from the coloring medium to be predominantly within first and second bands of wavelengths. The coloring agents are dispersed in a medium. The photopic light emissions from the coloring medium induce equal or nearly equal quantal absorptions of first and second populations of color photoreceptors in a dichromatic animal.

Also provided are methods of camouflaging materials using the coloring media described supra.

Also provided is a method of hunting or observing dichromatic animals. In this method, a material is constructed comprising a coloring agent, which limits photopic light emissions from said material to occur predominantly within a band of wavelengths at or about the neutral point of a dichromatic animal. The material is incorporated into clothing or equipment. The clothing is worn, or the equipment is used, in hunting or observing dichromatic animals.

Figure 1:
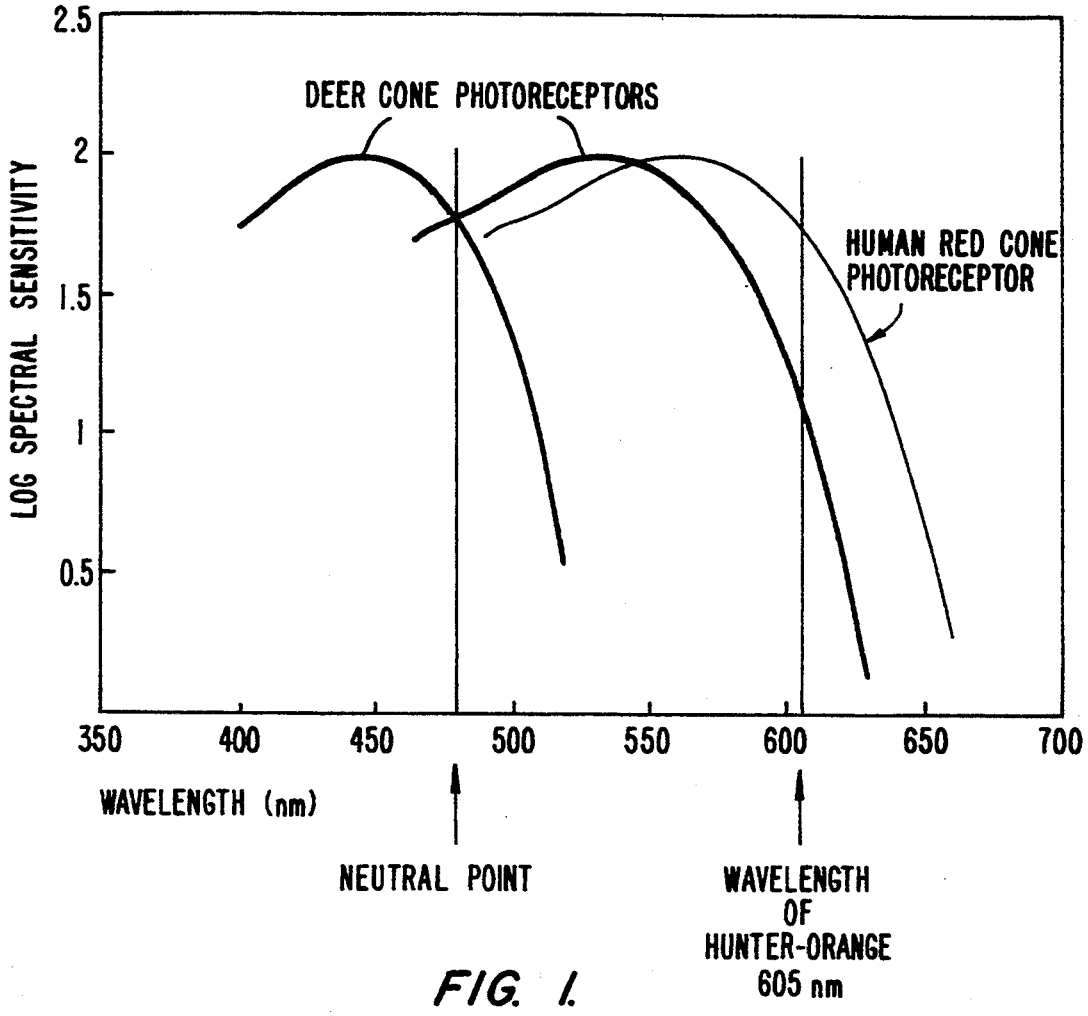
FIG. 1: Deer cone photopigment absorption profiles. The chart plots log photopic spectral sensitivity versus wavelength (nm) for each photoreceptor. The absorption profile of the human red-absorbing cone is also shown for comparison.
Figure 2:
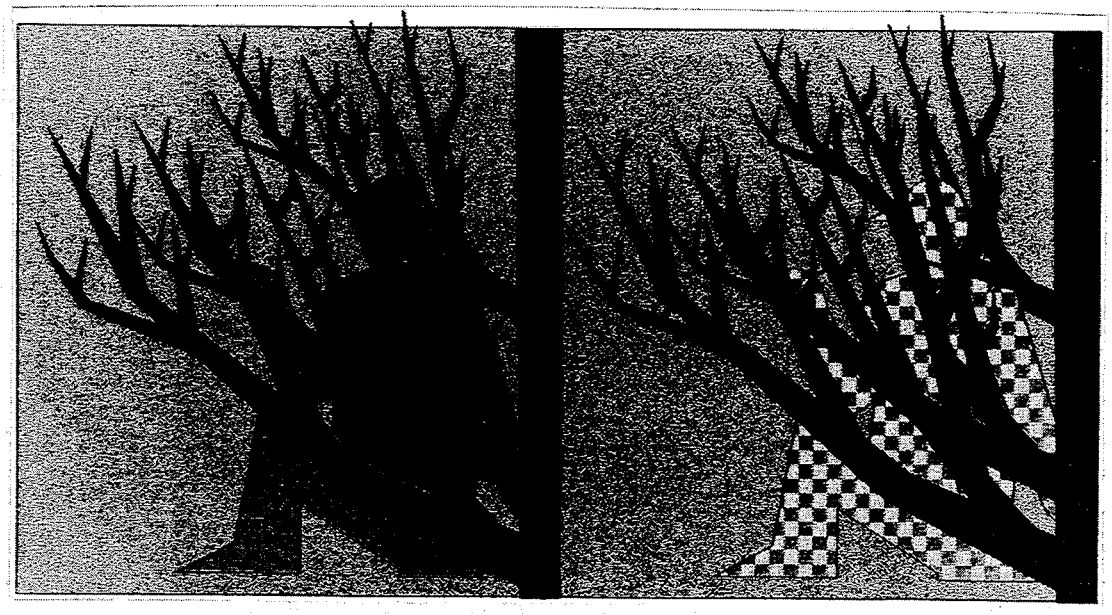
FIG. 2: Simulation of multichromatic neutral-point material. The simulation can be achieved by producing color drawings having the features outlined in the black and white figure. In each panel, the tree should be a yellow-tinted gray and the background gray. In the left panel, the hunter should be wearing daylight fluorescent orange and in the right panel, a check pattern of daylight fluorescent orange and blue-green.

When the drawing is viewed from a distance of about ten feet, the hunter wearing the checks disappears. From this distance, the human eye is unable to spatially distinguish the differently colored segments. The addition of blue-green to orange light mutes the brightness and cancels the coloration of the latter. The hunter therefore blends in closely with the gray background.

The same effect can be achieved more easily and dramatically for deer and other dichromatic animals than for humans. The difference is that with dichromatic animals, the proportion of blue (or other low wavelength light) required to achieve cancellation of orange color and brightness is much lower. The small proportion of blue (or other low wavelength emissions) required to cancel a dichromat's perception of the bright orange color is insufficient to make the color any less conspicuous to humans.

GLOSSARY OF TERMS

As used herein, the following terms have the meanings indicated.

The term "light" refers to radiation visible to humans or dichromatic animals. Thus, in addition to electromagnetic wavelengths visible to humans, "light" as used herein, encompasses near-UV irradiation that is visible to dichromatic animals.

The term "luminance" refers to radiation visible to humans.

The term "photopic light emissions" refers to light emitted by a material under daylight illumination, and encompasses (1) reflected incident light, (2) fluorescence (i.e., reemitted radiant light energy), and (3) phosphorescence originating from a material.

The term "photopic luminance" refers to luminance emitted by a material under daylight illumination and encompasses (1) reflected incident light, (2) fluorescence, and (3) phosphorescence.

"Daylight illumination" refers to incident sunlight between the times of sun-up and sun-down.

The term "luminosity factor" refers to luminance as a percentage of the intensity of incident radiation.

The term "brightness" refers to a psychophysical attribute of visual sensation according to which an area appears to exhibit more or less light.

When a material emits light "predominantly" within a band of wavelengths, the term "predominantly" indicates that at least 50% and preferably at least 75%, 85%, 95% or most preferably 100% of total emitted light is within the specified band of wavelengths.

"Dichromacy" refers to color vision based on two populations of photopigments.

When a wavelength of light is described as "at or about" a specified wavelength, the term "at or about" encompasses a range of +/− 25 nm.

When a wavelength of light is described as "about" a specified range of wavelengths, the term "about" encompasses a variation of +/− 5 nm at either end of the range.

DESCRIPTION OF THE SPECIFIC EMBODIMENTS

I. Neutral-Point Camouflage Materials a. General

In accordance with one embodiment of the invention neutral-point camouflage materials are provided. The camouflage materials emit a spectrum of photopic light of high visibility to a trichromatic human but of low visibility to deer and other dichromatic animals. The materials allow a human to remain inconspicuous to animals being observed or hunted, while at the same time being highly visible to other human beings, thereby avoiding the danger of the human being mistaken for a target animal. This effect is achieved by creating a material from which photopic light emissions occur at wavelengths of light at or about the neutral point of a dichromatic animal. The neutral point of a dichromatic animal is the wavelength of monochromatic light at which the two populations of color photoreceptors are equally stimulated. Whereas to a human, such a material appears in stark contrast to natural backgrounds, to a dichromatic animal it closely resembles the appearance of the natural background.

A forest or other natural background is perceived differently by humans and dichromatic animals. A human perceives a forest as a mixture of many colors including greens, browns and beiges. A dichromat, however, sees a much more restricted range of colors. As discussed supra, a dichromat can perceive only two primary colors, blue and yellow, with gradations of colorlessness in between. Most of the typical forest colors occur toward the yellow end of the spectrum. These colors are seen by the dichromat not as gradations of different colors, such as browns, greens and beiges, but as shades of dull gray tinged with varying degrees of yellow.

A dichromat's perception of conventional Hunter's Orange clothing contrasts strongly in brightness and color with this background perception. Dichromats, such as deer, perceive light of the Hunter's Orange wavelengths as a moderately bright and, for them, relatively brilliant yellow. (See FIG. 1.) This color contrasts strongly with dichromat's predominantly dull-gray perception of a natural backgrounds. Thus, the brilliant orange color of conventional clothing achieves safety at some cost to utility and is far from ideal.

Neutral-point camouflage materials are much less conspicuousness to animals than Hunter's Orange clothing but offer a comparable degree of safety. To humans, which have no neutral point, the light at the neutral point appears intensely colored and bright. For example, monochromatic light at the deer's neutral point of 480 nm would appear as an intense and bright blue/green color to humans. By contrast, to deer, light at the neutral point appears colorless and dim, that is, dull gray.

The different perceptions of humans and dichromatic animals to a natural background and a neutral-point material give rise to an effective camouflage. A human sees the neutral-point material as an intense, bright monochromatic color against a background of browns, tans, yellow, greens and beiges. A dichromatic animal sees the neutral-point material as a dull gray against a background comprising varying shades of gray and very muted colors. A human wearing the material is therefore highly visible to other humans and highly inconspicuous to dichromatic animals.

Because neutral-point monochromatic camouflage materials exploit differences in color vision, they are most effective during daylight hours. After dark, neither humans nor animals are able to distinguish colors to any appreciable extent.

b. Monochromatic neutral-point materials

In one embodiment, the camouflage material is constructed such that its photopic light emissions lie predominantly within a single band of wavelengths at or about the neutral point of a dichromatic animal (hereinafter "monochromatic neutral-point material"). Material having this emission characteristic is achieved by incorporating one or more coloring agents that limit photopic emissions predominantly within the desired spectral band of wavelengths, that is at or about the neutral point of a dichromatic animal. The neutral points of dichromatic animals measured to-date lie in a range from about 470–510 nm. In a preferred embodiment, the desired spectral band of wavelengths is at or about 480 nm, this being the neutral point of deer. (See Example 1.)

Monochromatic neutral-point material whose photopic light emissions lie predominantly at or around 480 nm appears a bright blue/green color to humans, but a dull gray to deer. The dull gray color provides an effective camouflage against detection by deer in a wide variety of natural settings. However, monochromatic neutral-point material is most useful as a camouflage in winter conditions, when the bright blue/green color (as perceived by humans) contrasts strongly with a leafless natural background, thereby ensuring high visibility of the human wearer.

Although monochromatic neutral-point material is an effective camouflage it does not comport with the legislative requirements discussed infra, applicable in many states. Thus, the present utility of monochromatic neutral-point material is confined to nonhunting observational purposes (to which hunting regulations typically do not apply), and to hunting in states that do not have such legislative requirements. However, in recognition of the utility of neutral-point material, it is possible that legislative requirements will change, so as to broaden the circumstances when monochromatic neutral-point material can be used.

c. Multichromatic neutral-point materials

Multichromatic neutral-point materials have all the utility of monochromatic neutral-point materials, with the added advantage they can be designed to conform to legislative requirement of many states.

1. Legislative requirements

At present many U.S. states and Canadian provinces, including Alabama, Arkansas, Colorado, Delaware, Florida, Georgia, Illinois, Indiana, Iowa, Kansas, Kentucky, Louisiana, Maine, Maryland, Massachusetts, Michigan, Minnesota, Mississippi, Missouri, Montana, Nebraska, New Brunswick, New Jersey, North Dakota, Nova Scotia, Oklahoma, Pennsylvania, Quebec, Rhode Island, Saskatchewan, South Carolina, Tennessee, Texas, Utah, Virginia, Washington, West Virginia, Wisconsin, and Wyoming, have laws designed to ensure visibility of hunters to prevent hunting accidents. These laws typically require that hunting clothing emit at least 85% of total visible emissions (i.e. luminosity) in a narrow band of wavelengths ranging between 595–605 nm, with a luminosity factor of at least 40%. See, e.g. 7 Del. Code Ann. 725(a) (1991); 207 New Hamp. Rev. Stat. Ann. 38-(b) (1990); N.J. Stat. 23:4–13.1 (1991); Tenn. Code Ann. 70-4-124 (1991); Neb. R. Stat. 37-215.05 (1990); 12 Maine Rev. Stat. 7001 (1990). These parameters are specified to ensure clothing appears bright orange to the human eye and is easily discernable from a forest background.

2. Assembly

In this embodiment, the camouflage materials incorporate at least two different coloring agents. Each coloring agent is contained in different segments of the material and limits the photopic light emissions from those segments to be predominantly within a band of wavelengths. The predominant spectral characteristics and the relative proportions of the multiple coloring agents are selected such that combined photopic light emissions from segments incorporating the different coloring agents induce equal or nearly equal quantal absorptions in a dichromat's two populations of color photoreceptors. The dichromatic animal perceives the same overall color appearance from the combined photopic emissions as it would from a monochromatic photopic emission at or about the neutral point. The equations presented below are used to calculate the relative quantities of two coloring agents to incorporate into a material to achieve this effect.

A monochromatic neutral-point light composed of a narrow band of wavelengths (w1) matches the appearance of a second light composed of a mixture of two narrow wavebands of light (w2 and w3) emitted by first and second segments containing different coloring agents, when the mixture and the monochromatic light produce equal quantal absorptions in the photopigments. For a dichromatic eye with two photopigments (p1 and p2), such a match can be achieved by adjusting the intensity ratio, I(w2)/I(w3), of photopic emissions at wavebands w2 and w3. That ratio can be calculated by solving simultaneous linear equations that equate the photons absorbed from the neutral point light (w1) with those absorbed from the mixture (w2+w3) for each individual photopigment.

Photopigment 1 $S(p1,w1)\ I(w1)=S(p1,w2)I(w2)+S(p1,w3)I(w3)$

Photopigment 2 $S(p2,w1)\ I(w1)=S(p2,w2)I(w2)+S(p2,w3)I(w3)$

Solving the two equations simultaneously for the ratio, I(w2)/I(w3) yields:

$$I(w2)/I(w3)=[S(p2,w3)/S(p2,w1)-S(p1,w3)/S(p1,w1)]/[S(p1,w2)/S(p1,w1)-S(p2,w2)/S(p2,w1)]$$

where:

I is the intensity (I) of the light incident on the photopigment (photons/square area/sec).

S is the sensitivity of the photopigment to light, which is the fraction of photons absorbed from the light (number of photons absorbed/total number of photons incident).

S(p1, w1) is the Sensitivity of Photopigment 1 to light 1 (the neutral point of light)

S(p1, w2) is the Sensitivity of Photopigment 1 to light 2 (the first component in the mixture)

S(p1, w3) is the Sensitivity of Photopigment 1 to light 3 (the second component in the mixture)

S(p2,w1) is the Sensitivity of Photopigment 2 to light 1 (the neutral point of light)

S(p2, w2) is the Sensitivity of Photopigment 2 to light 2 (the first component in the mixture)

S(p2, w3) is the Sensitivity of Photopigment 2 to light 3 (the second component in the mixture)

I(w2) is the intensity of light 2 (the first component in the mixture)

I(w3) is the intensity of light 3 (the second component in the mixture)

Values for S(p1, w1), S(p1, w2) S(p1, w3), S(p2, w1), S (p2,w2) and S(p3,w3) are obtained from a chart measuring sensitivity (S) versus wavelength (W) for two photopigments (p1 and p2), such as the chart in FIG. 1. The ratio I(w2)/I(w3) is then solved from the above equations. The relative proportions of first and second coloring agents incorporated into the camouflage material are empirically adjusted so that intensity of photopic light emissions from the material at wavebands w2 and w3 is in the ratio I(w2)/I(w3).

The multi-colored segments resulting from incorporation of at least two coloring agents are arranged so that they are generally perceived as a single homogenous color. In these arrangements, the segments are sufficiently small and closely interspaced that they cannot be resolved as distinct spatial components by a dichromatic animal observer except perhaps at very close range. As a practical matter, a human observer rather than a dichromatic animal is typically used to determine whether different colored segments can be resolved. With the possible exception of some nonhuman primates, the acuity of humans is superior to that of all mammals measured to date. Thus, if a normal human observer is unable to resolve a spacial arrangement of segments, then most mammals will not be able to resolve the segments either.

The criterion for determining whether a human observer is able to spatially resolve the segments is a Two-Alternative Forced Choice Test. In this test, the human observer is asked to distinguish a test material containing different colored segments from a control material of a single homogenous color. The test is repeated many times. The observer is unable to spatially distinguish the multicolored segments when she fails to correctly identify the multichromatic neutral-point material at a greater frequency than chance (i.e. 50%).

Preferably, the segments of color are so small and closely spaced that they cannot be resolved at any range. This is accomplished by intertwining differently colored threads, with each thread incorporating a different coloring agent that limits photopic light emissions from that thread to be predominantly within one of the desired bands of wavelengths. Alternatively, the camouflage material is formed by dyeing or coating material with a dye, paint or finish containing a homogenous mixture of the two or more coloring agents. This ensures that the coloring agents are homogeneously distributed throughout the material and that the resulting microscopic zones of color cannot be spatially distinguished by the unaided human eye at any distance.

Other camouflage materials in which the individual segments of color are less closely spaced are also useful. In these materials a human observer can resolve individual segments from a very short distance, but not from longer distances, such as 3, 10, 50, 100, 500, or even 1000 meters, from which dichromatic animals are typically observed. The greater flexibility in spacing of segments allows the different coloring agents to be incorporated in repeating patterns, for example, stripes or pleats, which may have a more pleasing aesthetic appearance than that of camouflage materials in which the colored segments are more closely associated. Provided that an even distribution of segments is maintained, nonrepeating or even random patterns are also possible. In all of these arrangements, the size of individual segments is generally smaller than 5 square centimeters and sometimes smaller than one tenth of a square centimeter.

Multichromatic neutral point material usually comprises one coloring agent limiting photopic light emissions to the yellow end of the spectrum and another coloring agent limiting photopic light emissions to the blue end of the spectrum. For example, one coloring agent usually limits photopic light emissions from about 490–640 nm and the other coloring agent usually limits photopic light emissions from about 380–470 nm. The coloring agents are incorporated in relative proportions, according to the principles discussed above, such that combined photopic emissions simulate light at or around the neutral point.

As noted supra, a particular advantage of camouflage material comprising two distinct coloring agents is that it can be designed to conform to legislative requirements specifying that hunting clothing emit a high proportion of luminance within a specified band of wavelengths. The first coloring agent is selected to limit photopic light emissions predominantly to the band of wavelengths specified by the legislature. For example, to satisfy the typical requirements of many states, discussed supra, a first coloring agent is selected to limit photopic light emissions to a band of wavelengths from about 595–605 nm.

The first coloring agent also must be incorporated into the garment in such a quantity, relative to the second coloring agent, that the proportion of total photopic luminance contributed by the first coloring agent satisfies any legislative requirement as to the proportion of total luminance that must fall within a specified band of wavelengths. For example, many states typically require that 85% of luminance emitted by camouflage clothing fall within the 595–605 nm range. To achieve this high percentage of total luminance within the required range, the first coloring agent is typically present in considerable excess over the second coloring agent.

The second coloring agent is selected in accordance with the principles and equations discussed above, so that the overall color appearance of photopic light emissions of material incorporating the two coloring agents is equivalent to that produced by monochromatic light at or about the neutral point of the dichromatic animal. This occurs when the combination of photopic emissions from the first and second segments in the material induces equal or nearly equal quantal absorptions in the two populations of the dichromat's color photoreceptors. Typically, the second coloring agent limits photopic light emissions within a range of wavelengths between about 380–455 nm, the band which includes the near ultraviolet and blue regions of the electromagnetic spectrum. The proportion of total photopic luminance contributed by the second segments must not exceed 15% if the overall legislative requirement is to be satisfied.

Within the constraints already discussed, the first and second coloring agents are preferably selected so that the luminosity factor of multichromatic neutral-point material is at least 40%. A luminosity factor of 40% or greater is required by many legislatures for hunting clothing.

This novel multichromatic neutral-point material, which satisfies legislative requirements of emitting 85% of radiation at 595–605 nm, with a luminosity of at least 40% will appear differently to humans and dichromatic animals. The human eye is much more sensitive to far-yellow light (i.e. 595–605 nm) than it is to far-blue or near-ultraviolet light (380–440 nm). Because the material's spectrum comprises about 85% far-yellow light, to which the human eye is relatively sensitive and only a small proportion of blue or near-ultraviolet light, to which the eye is relatively or completely insensitive, the human eye will perceive the material as being tinted slightly pink from pure 595–605 nm far-yellow light. The resulting brilliant fluorescent pinkish orange color is even more visible to humans than conventional blaze orange. By contrast, the dichromat's eyes are far more sensitive to far-blue and near-ultraviolet light than to far-yellow light. Even though the far-blue and near-ultraviolet light contributes only a small proportion of the material's total emissions, this proportion is sufficiently large to produce an equal or nearly equal quantal absorptions of the dichromat's two cone photoreceptor populations. This generates a dull-gray or slightly tinted dull-gray appearance that is equivalent to that seen by the dichromatic animal at or about its neutral point. The phrase "equal or nearly equal quantal absorptions" encompasses the same variation in quantal absorptions as would be caused by different wavelengths of light within +/− 25 nm of the neutral point.

The presently preferred bands of wavelengths and proportions of light may become outdated by legislative change. For example, if the legislative requirement were relaxed so that only 75% of total luminance must fall between 595–605 nm, the spectral purity of photopic emissions from the first segments could be relaxed, allowing greater flexibility and perhaps, greater economy in production of camouflage materials.

In another embodiment, a further variant of multichromatic neutral-point material is provided. Although this variant does not satisfy typical legislative requirements, discussed supra, it has other advantages. This material comprises one coloring agent that limits photopic light emissions from first segments of the material to be predominantly within a band of wavelengths at or about the neutral point of a deer, and a second coloring agent that limits photopic light emissions from second segments to be predominantly within a waveband at the far-red end of the visible spectrum, from about 640 nm to 700 nm. As disclosed in Example 1 and as illustrated by FIG. 1, deer are completely insensitive to far-red light of these wavelengths. The far-red coloring agent therefore appears black to a deer. To a deer, the combination of the far-red coloring agent with the neutral-point coloring agent effectively dilutes the amount of light emitted at the neutral point and gives the material a darker appearance. This type of camouflage is particularly advantageous when a deer is viewed from a dark background, because it darkens the gray appearance of pure monochromatic neutral point material to correspond more closely to the background. To humans, the combination of a dark red coloring agent with a neutral-point coloring agent still provides a strong contrast with a forest or other natural background. Moreover, in variants of this material in which the segments are sufficiently sized and spaced to be resolvable by the human eye at short range, the combination of dark-red and blue-green (neutral point) coloring agents, allows camouflage materials to be created in novel, unique, aesthetically pleasing patterns.

II. Low-visibility red camouflage materials

In another embodiment, the camouflage material is constructed such that photopic light emissions lie predominantly within a single band of wavelengths ranging from approximately 630 nm or 640 nm to 700 nm (hereinafter "low visibility red" material). As shown in FIG. 1, deer are completely insensitive to these wavelengths. Low-visibility red camouflage materials therefore appear black to deer, and provide an effective camouflage when the wearer is viewed against a dark background. Humans perceive these materials as dark red and can easily distinguish them from a forest or other natural background during daylight hours.

III. Dichromatic Animals

A dichromatic animal is one whose visual system has two populations of color photoreceptors. Known dichromatic species include ground squirrels (neutral point 505 nm), Jacobs, *Animal Behavior* 26:409–421 (1978), tree squirrels (neutral point 505 nm), Blakeslee et al. *Comparative Physiology* A 162:773–780 (1988), tree shrews (neutral point 507 nm), Jacobs and Neitz, *J. Vision Research* 26:291–298 (1986), pigs (neutral point 490 nm) Neitz and Jacobs, *Visual Neuroscience* 2:97–100 (1989), cats (neutral point unknown), Loop et al. (1987) *J. Physiol.* 382: 527–553, and dogs (neutral point 480 nm), Neitz et al., (1989). Other potentially dichromatic animals include rabbits, foxes, turkeys, numerous terrestrial birds and waterfowl, bears, sheep, horses, cows, elks and antelopes and other ungulates (i.e. hooved animals). Novel findings presented in Example 1 indicate that white-tailed and mule deer can be added to the list of dichromats.

IV. Coloring Agents and Materials

The term coloring agent encompasses dyes, pigments, paints, finishes and other compositions of matter that emit characteristic wavelengths of light. By "light", it is meant any part of the electromagnetic spectrum that is visible to humans or dichromatic animals. Thus, as used herein, the term "light" encompasses certain wavelengths of ultraviolet irradiation that are visible to animals but not to humans.

A wide variety of coloring agents are known in the art. See, for example, Needles, *Textile Fibers, Dyes, Finishes and Processes, A Concise Guide* (Noyes, N.J. 1986); Storey, *The Thames and Hudson Manual of Dyes and Fabrics* (Thames and Hudson, London 1992). A suitable coloring agent is selected by irradiating a sample with monochromatic light of known wavelength and determining its emission spectrum. See Boynton, *Human Color Vision* (Holt Rhinehart-Winston, N.Y. 1979), Hunt, *Measuring Color* (Wiley, N.Y. 1987); Judd Wyszecki, *Color in Business, Science and Industry,* (Wiley, N.Y. 2d ed. 1975), Wyszecki Stiles, *Colour Science* (Wiley, NY 2d ed. 1982). For multichromatic neutral-point materials emitting light predominantly in the 595–605 nm range, the coloring agent used in Ten Mile Cloth (manufactured by Highland Industries, Greensboro, N.C.) or that in Blaze Orange cloth is suitable.

The term "material" is intended to encompass any material used for observing animals into which coloring agents can be incorporated. For example, the term includes fabrics, wood, metal, plastic and glass. Fabrics are a preferred form of material because they can be used to construct hunting or observational clothing for which camouflage is especially necessary. The term "fabric" includes, for example, any cloth produced by joining fibers, as by knitting, weaving, sewing or felting.

V. Uses of Camouflage Materials

The camouflage materials provided by the invention have a variety of uses. Camouflage fabrics are used to manufacture clothing, particularly outergarments, such as a coat, jacket, suit, hat, pants, boots, socks, belt, and gloves. The camouflage materials are also useful for manufacturing garments for farm animals and hunting dogs to avoid their being mistaken for deer. Other camouflage materials are used to construct optical instruments, such as cameras or binoculars, or other items, such as observational screens, backpacks, tents, tarps, firearms, bows, arrows, vehicles or other accessory equipment. The camouflage clothing and equipment are useful for hunters, naturalists, birdwatchers, zoologists, photographers and artists who need to observe dichromatic animals in a natural habitat.

Customization of Camouflage Materials

The neutral points of most dichromatic species analyzed to date lie within a fairly narrow range, from about 480 nm (deer) to about 505 nm (ground squirrels). Thus, a camouflage material of the present invention is likely to be somewhat effective against any dichromatic animal. If, however, a suspected dichromatic animal of interest were identified whose photoreceptors had significantly different absorption profiles from deer, specialized camouflage materials can be constructed such that the mixture of light emitted causes equal or nearly equal stimulation of that particular animal's photoreceptors.

Because a dichromatic animal's visual perception is relatively insensitive to small variations in wavelength at or about the neutral point, the neutral-point camouflage materials are effective against most natural background under most lighting conditions. Take, for example, the different backgrounds provided by a deciduous forest in summer and winter. To a human, there is a marked changed in coloration. To a dichromatic animal, however, the seasonal transition is merely from an average stimulus very close to the neutral point (green leaves), to an average stimulus slightly to the yellow side (bare trees). Neutral-point camouflage backgrounds are therefore generally effective against both backgrounds.

Notwithstanding the general utility of neutral-point camouflage materials, customized materials also can be constructed for use against unusual backgrounds or unusual lighting. For example, if incident light contains a high proportion of near-uv irradiation, multichromatic neutral-point fabric requires a smaller proportion of the low-wavelength coloring agent to achieve equal stimulation of a dichromatic animal's two photopigments. Camouflage materials can be customized to match different backgrounds with equal facility. For example, to customize the fabric to match a forest with yellow-red autumnal leaves, the coloring agent or agents are selected so that the emitted light is at wavelength slightly higher than a dichromatic animal's neutral point.

VII. Other embodiments

1. Coloring media

Also provided according to a further embodiment of the invention are camouflage coloring media. The term coloring media includes, for example, dyes, paints finishes and other agents used to impart color to materials. The compositions of coloring media are analogous to those of the camouflage materials. In one embodiment, the coloring medium comprises one or more coloring agents that emit light at or about the neutral point of a dichromatic animal. In a second embodiment, the coloring medium comprises a mixture of at least two coloring agents and the combined spectrum of the two coloring agents simulates neutral-point monochromatic light, as discussed supra. The two or more coloring agents are dispersed in, for example, a dye or paint medium, of which many are well known in the art. See e.g., Storey, supra. The two or more coloring agents must be selected such that mixing does not perturb the respective spectral characteristics of each coloring agent.

The camouflage coloring media are used for treating uncolored materials to convert them into camouflage materials. Methods of dyeing and painting are well known in the art.

2. Methods of camouflaging materials

Also provided are methods of constructing all of the different variants of camouflage materials described supra. Monochromatic neutral-point materials are constructed by dyeing, painting or coating material with a coloring media containing one or more coloring agents that limit photopic light emissions from the material as discussed supra. Low-visibility red materials are similarly constructed. Multichromatic neutral-point materials are produced by several methods which create an array of differently colored first and second segments. The materials can be dyed, painted or coated with a coloring medium containing at least two coloring agents that confer the spectral characteristic discussed supra. Alternatively, the materials can be produced by first dyeing, painting or coating a material with a coloring medium containing a first coloring agent and second, dyeing, painting or coating a material with a coloring medium containing a second coloring agent, the two coloring agents conferring the requisite spectral properties on the material as discussed supra. In a further method, two noncamouflage materials are produced, each containing a different coloring agent. The two materials are then joined to form a camouflage material, the two coloring agents conferring the requisite spectral characteristics. For example, the two materials can constitute different colored threads to be joined by interweaving. Alternatively, the two material may be sheets of cloth. First and second segments are cut out of the first and second materials and quilted together to form a camouflage material. Alternatively, segments are cut from one material and attached to a sheet of the other material.

3. Methods of hunting

Also provided are methods of hunting or observing dichromatic animals by wearing neutral point clothing or using neutral-point equipment constructed from monochromatic neutral point material.

EXAMPLE 1

Measuring Color Photopigment Absorption Profiles and Determining the Neutral Point of Deer.

The spectral sensitivities of the photopigments in white tailed deer (*Odicoileus virginianus*) were measured by a noninvasive electrophysiological technique. The electroretinogram (ERG) of the anesthetized deer was measured by placing a contact lens electrode on the surface of the cornea and then recording the electrical potentials evoked by stimulating the eye with light. The eye was stimulated with a rapidly-pulsed, monochromatic light. Variations in pulse rate, stimulus wavelength, and adaptation state of the eye allowed preferential access to signals from different classes of photoreceptor. Recordings were obtained from nine white-tailed deer. Three classes of photopigments were detected. One of these is the photopigment contained in rods. It was found to have a peak sensitivity of about 496 nm, a similar value to that found for rod photopigments of other mammals. These measurements identified two classes of cone. One class contains a photopigment maximally sensitive at 537 nm, the other is maximally sensitive at 455 nm.

The presence of two classes of cones revealed by this experiment is the first evidence that deer are a dichromatic species. The neutral point is the wavelength at which the absorption profiles of the two classes of cones intersect, namely, about 480 nm.

FIG. 1 also shows the relative sensitivities of deer and humans to 595–605 nm light emitted by Hunter's Orange materials. The Figure indicates that although human sensitivity is greater, deer have substantial sensitivity to these wavelengths, thereby in part explaining the inadequacy of Hunter's Orange Camouflage materials.

FIG. 1 also shows that the deer's photopic spectral sensitivity is much lower than human photopic spectral sensitivity in the red portion of the visible spectrum. In that region, the deer's sensitivity is determined almost exclusively by stimulation of its long wavelength cone receptor that has a peak absorption at 537 nm. By contrast, the peak sensitivity of the human long wavelength cone receptor is 560 nm. It is this 20–25 nm displacement in peak sensitivity that underlies the relative insensitivity of the deer visual system to red light. FIG. 1 indicates that deer require about ten times more visible light energy to detect pure red 630 nm light than do normal humans and are almost entirely unable to detect wavelengths beyond 650 nm. As a practical matter, this means that the range of colors that normal humans describe as vivid red to deep red appear to deer as brown (very dim yellow) and near black respectively. The difference in long wavelength perception between deer and humans explains the utility of low-visibility red camouflage materials.

EXAMPLE 2

Testing the efficacy of camouflage fabrics

Neutral-point camouflage material constructed accorded to the principles discussed above are tested on human with red color blindness (protanopes). See Guyton, *Textbook of Medical Physiology* (7th ed. 1986). Human protanopes, who comprise about 1% of the human population, lack the red-absorbing cones present in most humans. Because they have only two populations of cone photoreceptors (blue- and green-absorbing) protanopes have dichromatic vision.

For example, targets covered in monochromatic neutral-point material or Hunter's Orange material are placed in a forest or other natural background at varying distances from a human protanope subject. The time taken by the protanope to discern each target is measured. The longer reaction times observed for monochromatic neutral-point material demonstrate the reduced visibility of this material to a dichromatic subject compared with conventional Hunter's Orange.

Similar experiments are performed for multichromatic neutral-point material. However, because human protanopes have reduced sensitivity to low wavelength light compared with animal dichromats, some extrapolation of results is necessary. For effectiveness against human protanopes, test multichromatic neutral-point materials must incorporate a higher proportion of low-wavelength-emitting coloring agent that is required for effectiveness against dichromatic animals.

The foregoing description of the preferred embodiments of the present invention has been presented for purposes of illustration and description. They are not intended to be exhaustive or to limit the invention to the precise form disclosed, and many modifications and variations are possible in light of the above teaching.

Such modifications and variations which may be apparent to a person skilled in the art are intended to be within the scope of this invention.

All publications and patent applications cited herein are incorporation by reference for all purposes to the same extent as if each individual publication or patent application was specifically and individually indicated to be incorporated by reference.

What is claimed is:

1. A camouflage material comprising:

first segments containing a first coloring agent, which causes photopic light emissions from said first segments to occur predominantly within a first band of wavelengths, second segments containing a second coloring agent, which causes photopic light emissions from said second segments to occur predominantly within a second band of wavelengths, wherein a normal human observer cannot spatially resolve said first and second segments from a distance of 100 meters in a Two-Alternative Forced Choice Test, and wherein combined photopic light emissions from said first and second segments induce the same perception of color in a deer as a monochromatic light at 480 +/− 25 nm.

2. The material of claim 1, wherein said human cannot spatially resolve said first and second segments from a distance of 15 meters.

3. The material of claim 2, wherein said human cannot spatially resolve said first and second segments from a distance of 3 meters.

4. The material of claim 3, wherein said human cannot spatially resolve said first and second segments at any distance.

5. The material of claim 1, wherein said first band of wavelengths is from about 490–640 nm and said second band of wavelengths is from about 380–470 nm.

6. The material of claim 5, wherein said first band of wavelengths is from about 595–605 nm and said second band of wavelengths is from about 380–440 nm.

7. The material of claim 6, wherein at least 75% of combined photopic luminance from said first and second segments is within a band of wavelengths from about 595–605 nm.

8. The material of claim 7, wherein at least 85% of said combined photopic luminance is within a band of wavelengths from about 595–605 nm, and said first and second segments have a luminosity factor of at least 40%.

9. The material of claim 8, wherein said material is a fabric.

10. The material of claim 9, wherein said first coloring agent is daylight fluorescent orange.

11. The material of claim 10, wherein said first segments comprise first threads, said second segments comprise second threads and said first and second threads are interwoven.

12. The material of claim 1, wherein said second segments are smaller than five square centimeters.

13. The material of claim 12 wherein said second segments are smaller than one tenth of one square centimeter.

14. The material of claim 13, wherein said second segments are randomly dispersed in said fabric.

15. The material of claim 13, wherein said second segments are evenly distributed in a repeating pattern.

16. The material of claim 1, wherein said first band of wavelengths is about 470–510 nm and said second band of wavelengths is about 640–700 nm.

17. An item of hunting or observational equipment comprising the camouflage material of claim 1.

18. The item of claim 17, wherein said item is an outergarment.

19. The camouflage material of claim 1, produced by dyeing a fabric with said coloring agents.

20. A camouflage material comprising:

a first and a second coloring agent which cause photopic light emissions from said camouflage material to be predominantly within a first and a second band of wavelengths, wherein said first and second coloring agents are homogeneously dispersed in said material, wherein said photopic light emissions induce the same perception of color in a deer as a monochromatic light at 480 +/− 25 nm, wherein said first coloring agent if incorporated alone into said camouflage material would cause photopic light emissions from said material to occur predominantly within said first band of wavelengths, wherein said second coloring agent if incorporated alone into said camouflage material would cause photopic light emissions from said material to occur predominantly within said second band of wavelengths.

21. A camouflage material comprising:

first segments containing a first coloring agent, which causes photopic light emissions from said first segments to occur predominantly within a first band of wavelengths, second segments containing a second coloring agent, which causes photopic light emissions from said second segments to occur predominantly within a second band of wavelengths, wherein a normal human observer cannot spatially resolve said first and second segments from a distance of 100 meters in a Two-Alternative Forced Choice Test, and wherein combined photopic light emissions from said first and second segments induce the same perception of color in a pig as a monochromatic light at 490 +/− 25 nm.

* * * * *